United States Patent [19]

Robins

[11] 4,319,422

[45] Mar. 16, 1982

[54] BULLETIN BOARD

[76] Inventor: Seymour Robins, Boardman St., Sheffield, Mass. 01257

[21] Appl. No.: 73,942

[22] Filed: Sep. 10, 1979

Related U.S. Application Data

[63] Continuation of Ser. No. 683,889, May 6, 1976, abandoned, which is a continuation of Ser. No. 499,173, Aug. 21, 1974, abandoned.

[51] Int. Cl.[3] ..... G09F 7/06; G09F 7/12; B65D 69/00

[52] U.S. Cl. ..... 40/622; 40/594; 206/223; 206/460; 428/455; 428/81; 434/96

[58] Field of Search ..... 206/460, 223, 459, 229, 206/224, 813; 434/96; 40/594, 595, 622; 428/41, 455, 456, 510, 509, 81

[56] References Cited

U.S. PATENT DOCUMENTS

| | | | |
|---|---|---|---|
| 275,692 | 4/1883 | Nielson . | |
| 1,499,220 | 6/1924 | Katzman | 206/223 |
| 2,096,389 | 10/1937 | Bode | 206/813 |
| 2,135,982 | 11/1938 | Masters | 434/96 |
| 2,610,588 | 9/1952 | Seagren et al. | 206/460 |
| 2,637,995 | 5/1953 | Mann | 72/18 |
| 2,777,626 | 1/1957 | French | 428/455 |
| 2,852,412 | 9/1958 | Hassel | 428/455 |
| 2,914,873 | 12/1959 | Brennan | 434/96 |
| 3,038,571 | 6/1962 | Clements | 52/464 |
| 3,283,888 | 11/1966 | Scott | 206/460 X |
| 3,384,982 | 5/1968 | Herbert et al. | 434/96 |
| 3,440,787 | 4/1969 | Bataille | 52/390 |
| 3,526,986 | 9/1970 | Dempnock et al. | 40/594 |
| 3,589,507 | 6/1971 | Greenberg et al. | 206/223 |
| 3,695,414 | 10/1972 | Wiesler et al. | 206/460 X |
| 3,725,188 | 4/1973 | Kalt | 206/813 |
| 3,755,053 | 8/1973 | Lindahl | 428/455 |
| 3,797,147 | 3/1974 | Lemberg | 206/459 |

FOREIGN PATENT DOCUMENTS

| | | | |
|---|---|---|---|
| 988743 | 5/1951 | France | 156/63 |

*Primary Examiner*—William T. Dixon, Jr.
*Attorney, Agent, or Firm*—Shenier & O'Connor

[57] ABSTRACT

A method of and apparatus for constructing a bulletin board on a suitable surface such, for example, as the wall of a room in which a template of a suitable material such, for example, as paper or plastic is formed with a plurality of spaced holes of a certain shape and size and in which areas of the surface of the template surrounding the holes preferably are color coded to provide different patterns of holes. The template is laid over the surface on which the bulletin board is to be constructed and a plurality of bodies of cork or cork-like material of the same shape and slightly smaller than the template holes are adhered to the wall through respective selected openings in one of the predetermined patterns to provide an array of bodies in a predetermined pattern and of a certain density. The pattern may expeditiously be repeated by placing a portion of the template over a part of the already formed pattern and then applying additional bodies to the surface through the remainder of the template.

17 Claims, 9 Drawing Figures

Fig 1
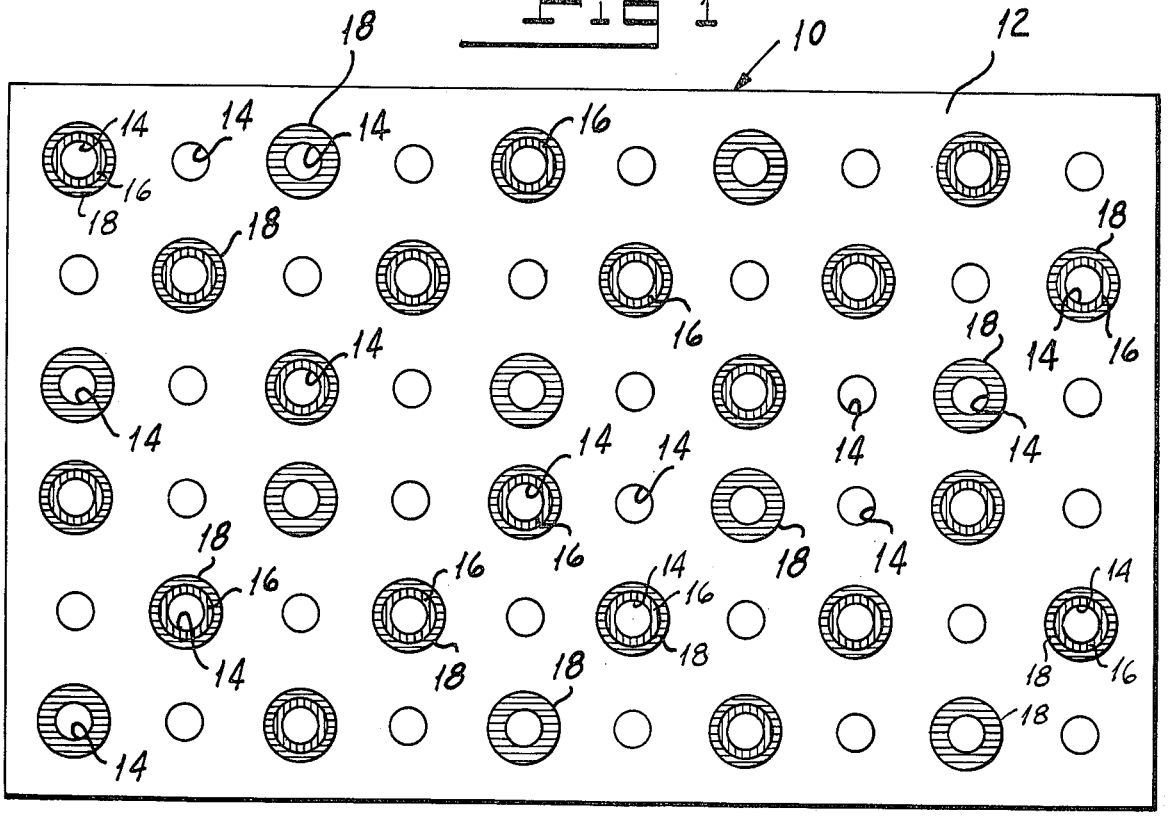
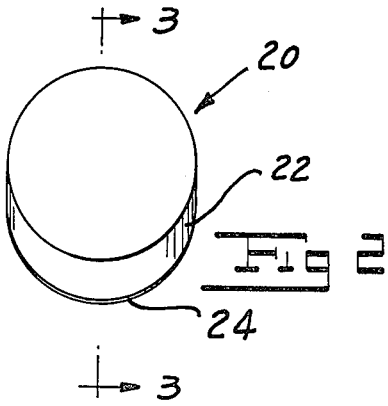
Fig 2
Fig 3
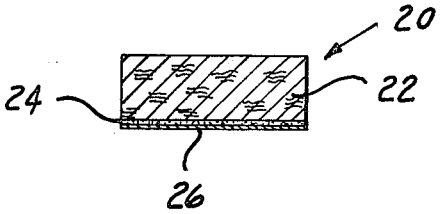
Fig 4
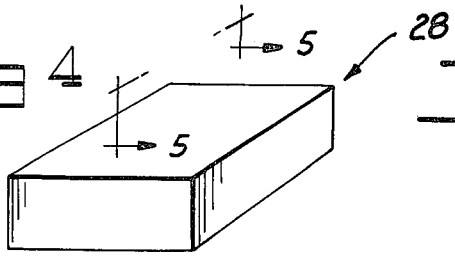
Fig 5
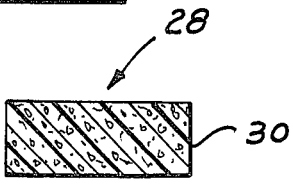
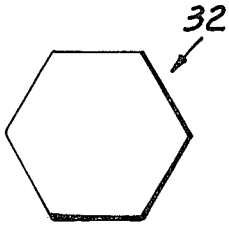
Fig 6

BULLETIN BOARD

This application is a continuation of my copending application, Ser. No. 683,889, filed May 6, 1976, now abandoned, which in turn is a continuation of my prior application Ser. No. 499,173, filed Aug. 21, 1974, now abandoned.

BACKGROUND OF THE INVENTION

Bulletin boards of the prior art generally are constructed as a square or rectangle of a sheet of cork or cork-like material adapted to receive thumb tacks or the like to secure articles of interest to the board. The board may or may not be framed. It is attached to a wall or the like by any suitable means such, for example, as by hanging it on picture hooks or by screwing it to the wall or the like.

While bulletin boards of the prior art adequately perform the utilitarian function of receiving thumb tacks or the like used to attach notices to the board, in general they are not only not attractive but are somewhat unsightly. I have invented a method of and apparatus for constructing a bulletin board which is at once functional and attractive. It involves the use of only a minimal amount of material. It is inexpensive to construct. It may be applied on any one of a number of surfaces without damaging the surface to which it is applied. My method permits of the construction of a bulletin board in a very rapid and expeditious manner. My method permits of a wide variation of decorative patterns for my bulletin board.

SUMMARY OF THE INVENTION

One object of my invention is to provide a method of and apparatus for constructing a bulletin board which is both functional and decorative.

Another object of my invention is to provide a bulletin board which is at once functional and attractive.

A further object of my invention is to provide a method of and apparatus for constructing a bulletin board in a rapid and expeditious manner.

Still another object of my invention is to provide a bulletin board which is inexpensive.

Yet another object of my invention is to provide a method of and apparatus for constructing a bulletin board on a surface without damaging the surface to which the bulletin board is applied.

Other and further objects of my invention will appear from the following description.

In general my invention contemplates the provision of a method of and apparatus for constructing a bulletin board in which I form a template by providing a sheet of material such as paper or plastic or the like provided with a plurality of spaced holes of regular size and shape. Preferably areas of the sheet around the holes are selectively color coded to provide various patterns of holes. The template is laid out over the surface on which the bulletin board is constructed and a plurality of discrete elements of cork or cork-like material are applied to the surface through the holes in one of the predetermined patterns provided by the template and are adhered to the surface by a pressure-sensitive adhesive or the like. When the template is removed, there remains on the wall a bulletin board in the form of a pattern of the cork-like elements which not only function to receive elements such as thumb tacks or the like, but which also provide a pleasing decorative effect. The pattern may be repeated over as large an area as is desired, merely by placing the template over a portion of the previous pattern and applying the elements through holes in the remaining portion of the template. My invention further contemplates the provision of a kit containing a template, a plurality of the cork-like board forming elements and an instruction booklet instructing the user on the manner in which various patterns and densities of elements can be applied to a wall or the like.

BRIEF DESCRIPTION OF THE DRAWINGS

In the accompanying drawings which form part of the instant specification and which are to be read in conjunction therewith and in which like reference numerals are used to indicate like parts in the various views:

FIG. 1 is a plan view of one form of template which I use in practicing my method and which forms a part of my apparatus for erecting a bulletin board.

FIG. 2 is a perspective view of one form of cork-like board forming element used in my method of, and forming a part of my apparatus for constructing a bulletin board.

FIG. 3 is a sectional view of the element illustrated in FIG. 2, taken along the line 3—3 of FIG. 2.

FIG. 4 is a perspective view of an alternate form of board forming element which I employ in my method of, and which forms a part of my apparatus for constructing a bulletin board.

FIG. 6 is a plan view of yet another form of board forming element which I use in practicing my method of, and which forms a part of my apparatus for constructing a bulletin board.

FIG. 9 is a plan view of a kit for practicing my method of, and containing my apparatus for erecting a bulletin board.

DESCRIPTION OF THE PREFERRED EMBODIMENT

Figure 8:
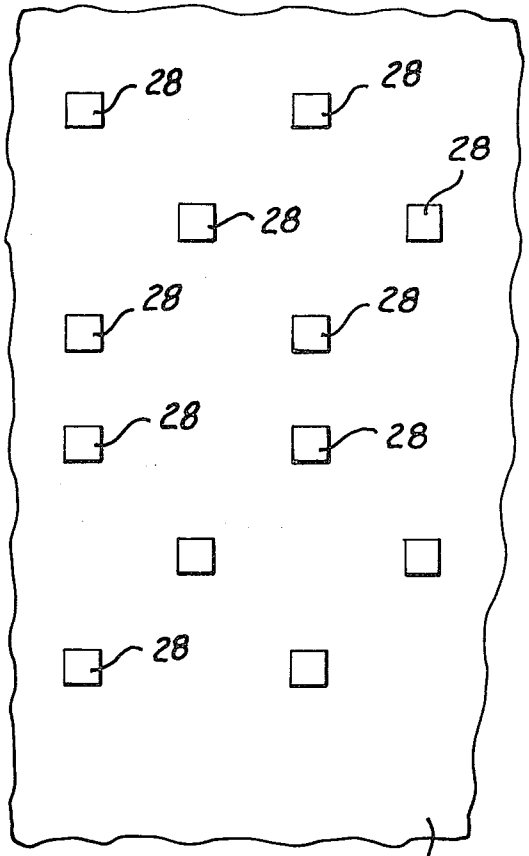
FIG. 8 is a fragmentary elevation of a wall on which an alternate form of my bulletin board has been constructed.

Referring now to FIG. 1 of the drawings, one form of template, indicated generally by the reference character 10, which I may use in my method of, and which may form a part of my apparatus for constructing a bulletin board, includes a sheet 12 of a suitable material. Preferably I form the sheet 12 from any relatively inexpensive material which is adapted to be rolled or folded to permit it to be stored in a box or the like and which may readily be unfolded and laid over the surface upon which the bulletin board is to be constructed. For example, the sheet 12 may be a sheet of paper or a sheet of flexible synthetic resin.

I provide the sheet 12 with a plurality of holes 14, which in the particular embodiment illustrated in FIG. 1 are round holes arranged in a pattern of rows and columns. It will readily be appreciated that the holes 14 may be other than round and they may be formed in the sheet 12 in a different pattern than the rows and columns shown.

Preferably I provide means for coding the holes to form various patterns of holes. By way of example, a first pattern of the holes 14 may be indicated by coloring areas 16 of the sheet 12 around the holes in the pattern with red as indicated by the vertical hatching in FIG. 1. A different pattern is indicated by coloring areas 18 around the holes in the other pattern with a blue color as indicated by the horizontal shading in FIG. 1. It will be seen that certain of the holes have no colored areas therearound, while others have inner areas 16 of red and outer areas 18 of blue and that other holes have only areas of blue therearound. Thus the template illustrated in FIG. 1 provides three different patterns of holes. Specifically, all of the holes provide one pattern, those surrounded by red areas 16 provide a second pattern, and those surrounded by blue areas 18 provide a third pattern. The manner in which the bulletin board is erected using the template 10 will be described in detail hereinbelow. It will readily be appreciated that other systems for coding the holes may be provided.

Referring now to FIGS. 2 and 3, one of the board forming elements, indicated generally by the reference character 20, adapted to be used with the template shown in FIG. 1 in the practice of my method of, and forming a part of my apparatus for constructing a bulletin board, includes a body 22 of cork or cork-like material adapted to receive thumb tacks and the like. Body 22 is cut to the shape of, and is made slightly smaller in diameter than a hole 14 of the template shown in FIG. 1 to permit the body 22 to be accurately placed in the hole while permitting removal of the template after the element 20 has been applied to the surface on which the board is to be constructed. In the preferred form of the element 20, the underside thereof is provided with a layer 24 of pressure sensitive adhesive and with a cover 26 overlying the layer 24 and adapted to be stripped therefrom prior to applying the element to the surface. It will readily be appreciated that the elements 20 can be formed to different shapes for use with templates having holes of correspondingly different shapes.

Figure 5:
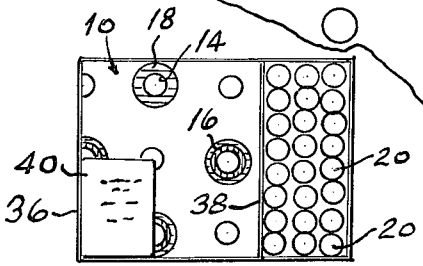
FIG. 5 is a sectional view of the element shown in FIG. 4 taken along the line 5—5 of FIG. 4.

Referring now to FIGS. 4 and 5, an alternate form of my board forming element, indicated generally by the reference character 28, is made square or rectangular in shape for use with a template having square or rectangular holes. In addition, rather than forming the body 30 of the element 28 from cork, I may, by way of example, make it from a suitable foamed synthetic resin of a consistency adapted to receive a thumb tack or the like. Referring to FIG. 6, yet another form of board forming element, indicated generally by the reference character 32, may be made hexagonal in shape so as to permit it to be used with a template having hexagonal holes.

Referring to FIG. 9, my apparatus for constructing a bulletin board is adapted to be stored in a box 36 to form a kit for constructing a bulletin board in any one of a number of patterns. The box 36 may be provided with a partition 38 forming a compartment for receiving a multiplicity of the elements 20 and another compartment adapted to receive the folded-up template 10. I provide a book of instructions 40 making up part of the kit and setting forth the various ways of using the template 10 to form bulletin boards in various patterns of the elements 20. Alternatively, to using a box, I may of course package the kit in any suitable container such as a bag or the like.

Figure 7:
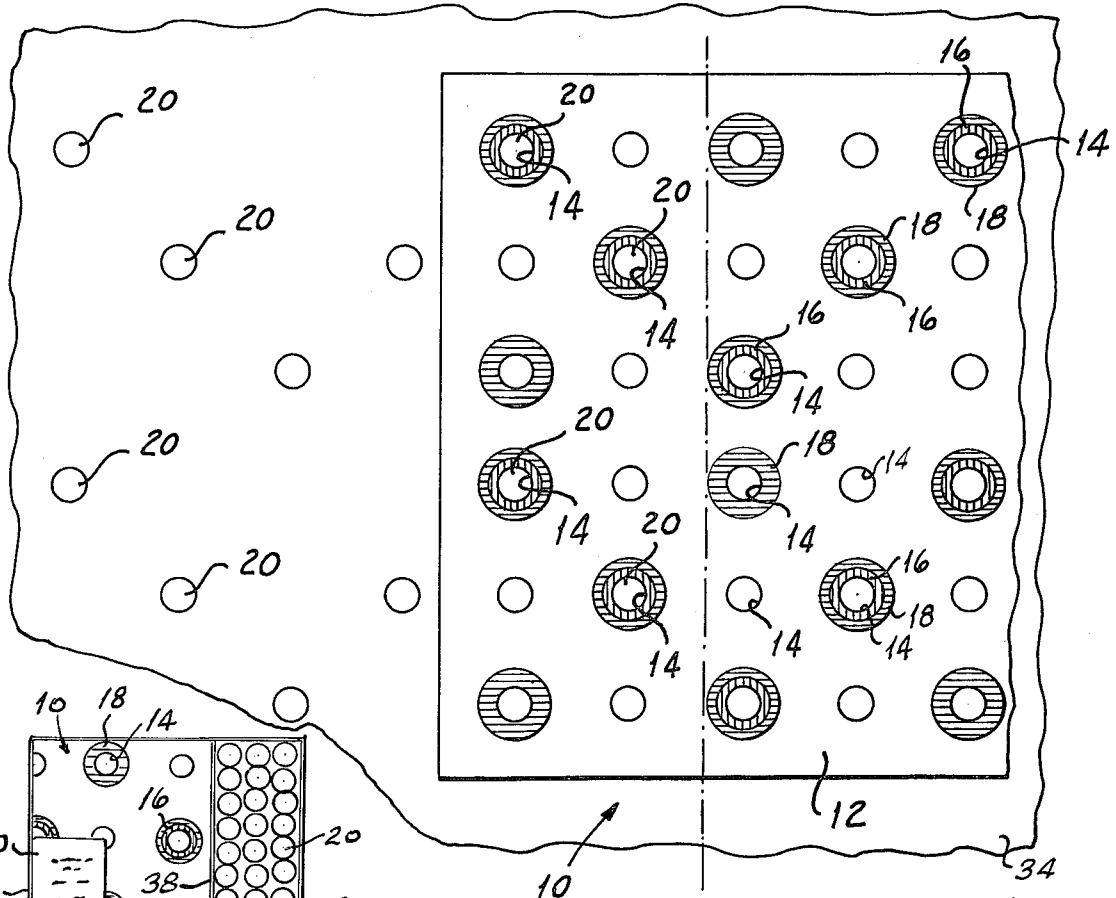
FIG. 7 is a fragmentary elevation of a wall showing part of a bulletin board erected according to my method and illustrating the manner in which a previously applied pattern can be repeated using my method of, and apparatus for constructing a bulletin board.

Referring now to FIG. 7, in use of the template 10 and the elements 20 to form a bulletin board on the surface of a wall 34 or the like, the template 10 is laid flat on the surface of the wall at the elevation at which it is desired to erect the board. My board may be erected on any suitable surface of wood, glass, tile, plaster, stone, concrete block, metal, plastic and the like. Any appropriate means such as pressure sensitive tape can be employed to hold the template in position during the construction of the bulletin board. Assuming, for example, that the user wishes to apply a pattern of the elements 20 in accordance with the pattern defined by those holes 14 which are coded in the color red, he holds the template in position against the wall 34 by any suitable means. Backings 26 are stripped off the pieces 20 and the pieces are inserted through the openings coded with red, so that the adhesive 24 adheres the pieces to the wall 34. This operation is carried out for all of the holes coded in red.

When the operation is complete, the pattern may end, for example, along a line corresponding to the dot-dash line in FIG. 7. If it should be desired to extend the pattern beyond this end, the template 10 is removed from the first run of the pattern and a portion thereof is placed over a terminal portion of the previously applied run in the manner indicated in FIG. 7. Then additional pieces 20 are applied to the wall through the remaining openings 14 of the template which are coded in red. This operation can be carried forward until the desired area has been covered with the pieces in the pattern of the red-coded holes 14 on the template 10.

Referring now to FIG. 8, I have shown an alternate form of my bulletin board, in which square elements 28 are employed to make up the pattern. In this instance, rather than providing pressure sensitive material 24 on the underside of the pieces 30, a suitable adhesive supplied with the kit can be used to adhere the pieces 28 to the wall 34. It will be noted, moreover, in the form of my bulletin board illustrated in FIG. 8 that the pattern formed corresponds generally to the blue-coded hole pattern of the template 10. It is to be understood further that, if desired, pieces could be applied through all of the holes 14 in the template 10 resulting in yet another pattern.

It will be seen that I have accomplished the objects of my invention. I have provided a method of, and apparatus for constructing a bulletin board which is at once functional and attractive. I have provided a method of, and apparatus for erecting a bulletin board in a rapid and expeditious manner. My bulletin board is inexpensive to construct. It is flexible in that many and various attractive patterns can be employed in constructing the bulletin board. It permits of erecting a bulletin board of any desired size. I have provided a kit for the construction of a bulletin board.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A bulletin board for receiving thumbtacks and push pins and the like including in combination a plurality of elements each formed of a material into which the pointed shaft of a thumbtack may be inserted, each element having a pair of generally planar and generally parallel surfaces of relatively small area, each element having a height between said surfaces sufficient to accommodate full insertion of the shaft of a thumbtack, means providing a generally flat and simply connected bonding surface, and means including a thin layer of adhesive for securing a major portion of the area of one planar surface of each element to and substantially flush against the bonding surface, said elements being secured to the bonding surface in a non-abutting relationship such that between elements there remains a permanently uncovered and visibly exposed space of the bonding surface which is at least a significant portion of the square root of the area of said surface of an element.

2. A bulletin board for receiving thumbtacks and push pins and the like including in combination a plurality of elements each formed of a material into which the pointed shaft of a thumbtack may be inserted, each element having a pair of generally planar and generally parallel surfaces of relatively small area, each element having a height between said surfaces sufficient to accommodate full insertion of the shaft of a thumbtack, means providing a generally flat and simply connected bonding surface, and means including a thin layer of adhesive for securing a major portion of the area of one planar surface of each element to and substantially flush against the bonding surface, said elements being secured to the bonding surface over a general area thereof which is appreciably greater than the sum of the areas thereof physically covered and masked by said elements and which includes a region thereof remaining permanently uncovered and visibly exposed, said exposed region having an area which is a significant portion of said general area.

3. A bulletin board for receiving thumbtacks and push pins and the like including in combination a plurality of elements each formed of a material into which the pointed shaft of a thumbtack may be inserted, each element having a pair of generally planar and generally parallel surfaces of relatively small area, each element having a height between said surfaces sufficient to accommodate full insertion of the shaft of a thumbtack, means providing a generally flat bonding surface, and means including a thin layer of adhesive for securing one planar surface of each element to and substantially flush against the bonding surface, said elements being secured to the bonding surface in a non-abutting relationship such that between elements there remains a permanently uncovered and visibly exposed space of the bonding surface which is at least a significant portion of the square root of the area of said surface of an element.

4. A bulletin board for receiving thumbtacks and push pins and the like including in combination a plurality of elements each formed of a material into which the pointed shaft of a thumbtack may be inserted, each element having a pair of generally planar and generally parallel surfaces of relatively small area, each element having a height between said surfaces sufficient to accommodate full insertion of the shaft of a thumbtack, means providing a generally flat and simply connected bonding surface, and means including a thin layer of adhesive for securing one planar surface of each element to and substantially flush against the bonding surface, said elements being secured to the bonding surface in a non-abutting relationship such that between elements there remains a permanently uncovered and visibly exposed region of the bonding surface.

5. A bulletin board for receiving thumbtacks and push pins and the like including in combination a plurality of elements each formed of a material into which the pointed shaft of the thumbtack may be inserted, each element having a pair of generally planar and generally parallel surfaces of relatively small area, each element having a height between said surfaces sufficient to accommodate full insertion of the shaft of a thumbtack, means providing a generally flat bonding surface, and means including a thin layer of adhesive for securing a major portion of the area of one planar surface of each element to and substantially flush against the bonding surface, said elements being secured to the bonding surface in a non-abutting relationship such that between elements there remains a permanently uncovered and visible exposed region of the bonding surface.

6. A bulletin board as in claim 5 wherein one element is of generally right cylindrical shape.

7. A bulletin board as in claim 5 wherein one element is of generally right circular cylindrical shape.

8. A bulletin board as in claim 5 wherein the securing means includes a thin pressure sensitive adhesive layer coating substantially all the area of said one planar surface of one element.

9. A bulletin board as in claim 5 further including means comprising a removable template provided with a plurality of spaced openings for temporarily covering a portion of said exposed region.

10. A bulletin board for receiving thumbtacks and push pins and the like including in combination a plurality of elements each formed of a material into which the pointed shaft of a thumbtack may be inserted, each element having a pair of generally planar and generally parallel surfaces of relatively small area, each element having a height between said surfaces sufficient to accommodate full insertion of the shaft of a thumbtack, means providing a generally flat bonding surface, and means including a thin layer of adhesive for securing one planar surface of each element to and substantially flush against the bonding surface, said elements being secured to the bonding surface over a general area thereof which is appreciably greater than the sum of the areas thereof physically covered and masked by said elements and which includes a region thereof remaining permanently uncovered and visibly exposed, said exposed region having an area which is a significant portion of said general area.

11. A bulletin board for receiving thumbtacks and push pins and the like including in combination a plurality of elements each formed of a material into which the pointed shaft of a thumbtack may be inserted, each element having a pair of generally planar and generally parallel surfaces of relatively small area, each element having a height between said surfaces sufficient to accommodate full insertion of the shaft of the thumbtack, means providing a generally flat and simply connected bonding surface, and means including a thin layer of adhesive for securing one planar surface of each element to and substantially flush against the bonding surface, said elements being secured to the bonding surface over a general area thereof which is greater than the sum of the areas thereof physically covered and masked by said elements and which includes a region thereof remaining permanently uncovered and visibly exposed.

12. A bulletin board for receiving thumbtacks and push pins and the like including in combination a plurality of elements each formed of a material into which the pointed shaft of the thumbtack may be inserted, each element having a pair of generally planar and generally parallel surfaces of relatively small area, each element having a height between said surfaces sufficient to accommodate full insertion of the shaft of a thumbtack, means providing a generally flat bonding surface, and means including a thin layer of adhesive for securing a major portion of the area of one planar surface of each element to and substantially flush against the bonding surface, said elements being secured to the bonding surface over a general area thereof which is greater than the sum of the areas thereof physically covered and masked by said elements and which includes a region thereof remaining permanently uncovered and visibly exposed.

13. A bulletin board as in claim 12 wherein one element is of generally right cylindrical shape.

14. A bulletin board as in claim 12 wherein one element is of generally right circular cylindrical shape.

15. A bulletin board as in claim 12 wherein the securing means includes a thin pressure sensitive adhesive layer coating substantially all the area of said one planar surface of one element.

16. A bulletin board as in claim 12 further including means comprising a removable template provided with a plurality of spaced openings for temporarily covering a portion of said exposed region.

17. An unframed bulletin board for receiving thumbtacks and push pins and the like including in combination a plurality of elements each formed of a material into which the pointed shaft of a thumbtack may be inserted, each element having a pair of generally planar and generally parallel surfaces of relatively small area, each element having a height between said surfaces sufficient to accommodate full insertion of the shaft of a thumbtack, means providing a relatively massive structure such as a wall and the like having a generally flat and vertically extending surface, and means consisting essentially of a thin layer of adhesive for securing one planar surface of each element directly to and substantially flush against said structural surface, said elements being secured to said structural surface over a general area thereof which is greater than the sum of the areas thereof physically covered and masked by said elements and which includes a region thereof remaining permanently uncovered and visibly exposed.

* * * * *